US009010498B2

(12) United States Patent
Hsieh

(10) Patent No.: US 9,010,498 B2
(45) Date of Patent: Apr. 21, 2015

(54) SCREW-DRIVEN ELEVATION STRUCTURE

(75) Inventor: Wu-Teng Hsieh, Taichung (TW)

(73) Assignee: Hiwin Technologies Corp., Taichung (TW)

( * ) Notice: Subject to any disclaimer, the term of this patent is extended or adjusted under 35 U.S.C. 154(b) by 332 days.

(21) Appl. No.: 13/493,772

(22) Filed: Jun. 11, 2012

(65) Prior Publication Data

US 2013/0327597 A1 Dec. 12, 2013

(51) Int. Cl.
*B66B 9/02* (2006.01)

(52) U.S. Cl.
CPC ..... *B66B 9/025* (2013.01)

(58) Field of Classification Search
CPC ..... B66B 9/02; B66B 9/025; B66F 9/00; B66F 3/08
USPC ..... 187/214, 233, 268
See application file for complete search history.

(56) References Cited

U.S. PATENT DOCUMENTS 661,716 A * 11/1900 Gary ..... 187/268
1,563,792 A * 12/1925 Rickard ..... 187/267
2,802,549 A * 8/1957 de los Santos Izquierdo et al. ..... 187/268
4,287,967 A * 9/1981 Perkins ..... 187/268
4,752,102 A * 6/1988 Rasmussen ..... 297/344.2
8,292,040 B2 * 10/2012 Hsieh ..... 187/267
2010/0126807 A1 * 5/2010 Liao et al. ..... 187/254
2011/0155509 A1 * 6/2011 Hsieh ..... 187/267

FOREIGN PATENT DOCUMENTS

TW 543649 7/2003

* cited by examiner

*Primary Examiner* — William E Dondero
*Assistant Examiner* — Diem Tran
(74) *Attorney, Agent, or Firm* — Muncy, Geissler, Olds & Lowe, P.C.

(57) ABSTRACT

A screw-driven elevation structure includes: a first rail and a second rail; a first screw nut assembly having a first screw and a first nut, the first screw having a top end fixedly connected to a fixing unit, the first nut moving along the first screw; a power device disposed at an elevator and having a first driving portion and a second driving portion, the first driving portion being fixedly connected to the first nut; a second screw nut assembly having a second screw and a second nut, the second screw having a top end fixedly connected to the second driving portion, the second nut moving along the second screw; and a moving body fixedly connected to the second nut and moving along with the second nut. It is feasible to drive the moving body to move, by controlling only the power device, thereby incurring low manufacturing and control costs.

9 Claims, 7 Drawing Sheets

SCREW-DRIVEN ELEVATION STRUCTURE

BACKGROUND OF THE INVENTION

1. Technical Field

The present invention relates to elevation structures, and more particularly, to a screw-driven elevation structure.

2. Description of Related Art

Since population ageing and urban population concentration are ever-increasing, the demand for elevation structures is becoming heavier. A conventional elevation structure usually uses a steel hoist cable and pulleys for driving an elevator car to move up and down so as to convey people or freight from one floor to another in a building. Although the conventional steel hoist cable-style elevation structure not only incurs a low manufacturing cost but also benefits from sophisticated manufacturing technology, it poses an insidious safety issue—a severed steel hoist cable. Elevation structure manufacturers do make persistent efforts to study and improve the safety of the conventional steel hoist cable-style elevation structure. Still, it is not uncommon for elevator cars to plummet because of a severed steel hoist cable. Furthermore, there is still room for improvement in the conventional steel hoist cable-style elevation structure in routine examination and maintenance.

To cope with the aforesaid problems, a screw nut assembly-driven elevation structure is provided. A nut of the screw nut assembly is disposed around a screw thereof and thereby stops the screw from loosening. Hence, the screw nut assembly-driven elevation structure prevents the steel hoist cable from severing which might otherwise end up with a plummeting elevator car. However, not only does the length of the screw has a manufacturing limitation, but stress concentration also occurs to an overly long screw and thus compromises the material strength thereof. Therefore, Taiwan patent 543649 is put forth in an attempt to solve the aforesaid problem. However, Taiwan patent 543649 discloses two power sources which incur a high manufacturing cost, not to mention that the two power sources have to be controlled simultaneously, thereby adding to a control cost. Furthermore, Taiwan patent 543649 discloses a side transmission mechanism which is likely to cause the elevator car to move obliquely and thereby operate unsteadily.

SUMMARY OF THE INVENTION

It is an objective of the present invention to provide a screw-driven elevation structure with a single power source for driving an elevation structure car to move, thereby restricting control to the single power source and incurring a lower control cost than its conventional counterparts.

Another objective of the present invention is to provide a screw-driven elevation structure with an elevation structure car which is less likely to move obliquely but operates more steadily than its conventional counterparts.

In order to achieve the above and other objectives, the present invention provides a screw-driven elevation structure comprising: a first rail and a second rail parallel to each other and disposed on a fixing plane; a fixing unit for fixing the fixing plane or the first rail in place; a first screw nut assembly having a first screw and a first nut, the first screw having a top end fixedly connected to the fixing unit, and the first nut being disposed around the first screw and moving vertically along the first screw while the first nut and the first screw are rotating relative to each other; an elevator with two opposing ends having a first rail slot and a second rail slot, respectively, the first rail slot accommodating the first rail, and the second rail slot accommodating the second rail, thereby restricting the elevator to vertical movement along the first rail and the second rail; a power device disposed at the elevator and having a first driving portion and a second driving portion, the first driving portion being fixedly connected to the first nut and driving the first nut to rotate; a second screw nut assembly having a second screw and a second nut, the second screw having a top end fixedly connected to the second driving portion and being driven by the second driving portion to rotate, and the second nut being disposed around the second screw and moving vertically along the second screw while the second screw and the second nut are rotating relative to each other; and a moving body disposed between the first rail and the second rail and flanked by a third rail slot and a fourth rail slot, the third rail slot accommodating the first rail, and the fourth rail slot accommodating the second rail, thereby restricting the moving body to vertical movement along the first rail and the second rail, the moving body being fixedly connected to the second nut and moving along with the second nut.

Accordingly, by controlling the power device, it is feasible for the first driving portion and the second driving portion to drive the moving body to move upward and downward. Hence, the screw-driven elevation structure of the present invention not only incurs a lower manufacturing cost than its conventional counterpart, but also controls a single power device only and thus incurs a lower control cost than its conventional counterpart.

The power device has a gearbox and a motor. The gearbox is disposed at the elevator and has the first driving portion and the second driving portion. The motor is disposed at the gearbox for driving the first driving portion and the second driving portion. The gearbox is disposed between the first rail and the second rail.

Accordingly, the screw-driven elevation structure of the present invention is characterized in that the moving body is driven from the middle thereof to move up and down, so as to prevent an elevator car carried by the moving body from moving obliquely and enable the elevator car to operate steadily.

BRIEF DESCRIPTION OF THE DRAWINGS

Objectives, features, and advantages of the present invention are hereunder illustrated with a preferred embodiment in conjunction with the accompanying drawings, in which.

DETAILED DESCRIPTION OF THE EMBODIMENT OF THE INVENTION

Figure 1:
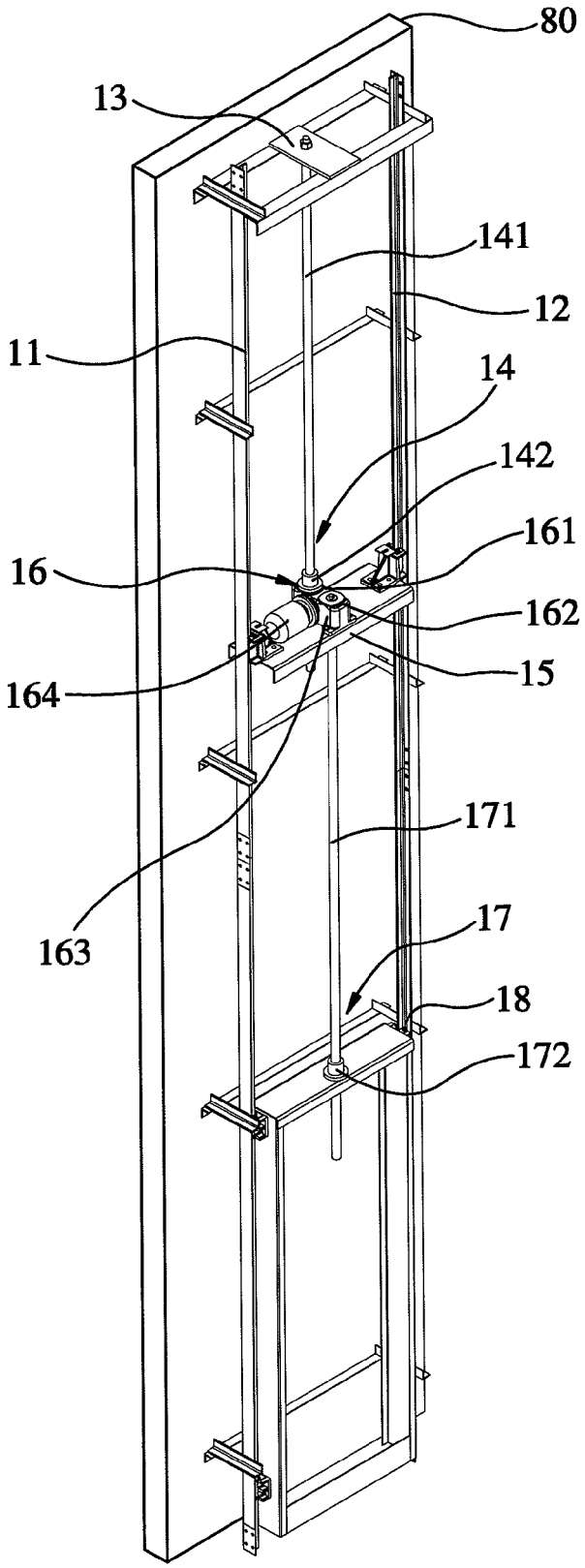
FIG. 1 is a perspective view of a preferred embodiment of the present invention.
Figure 2:
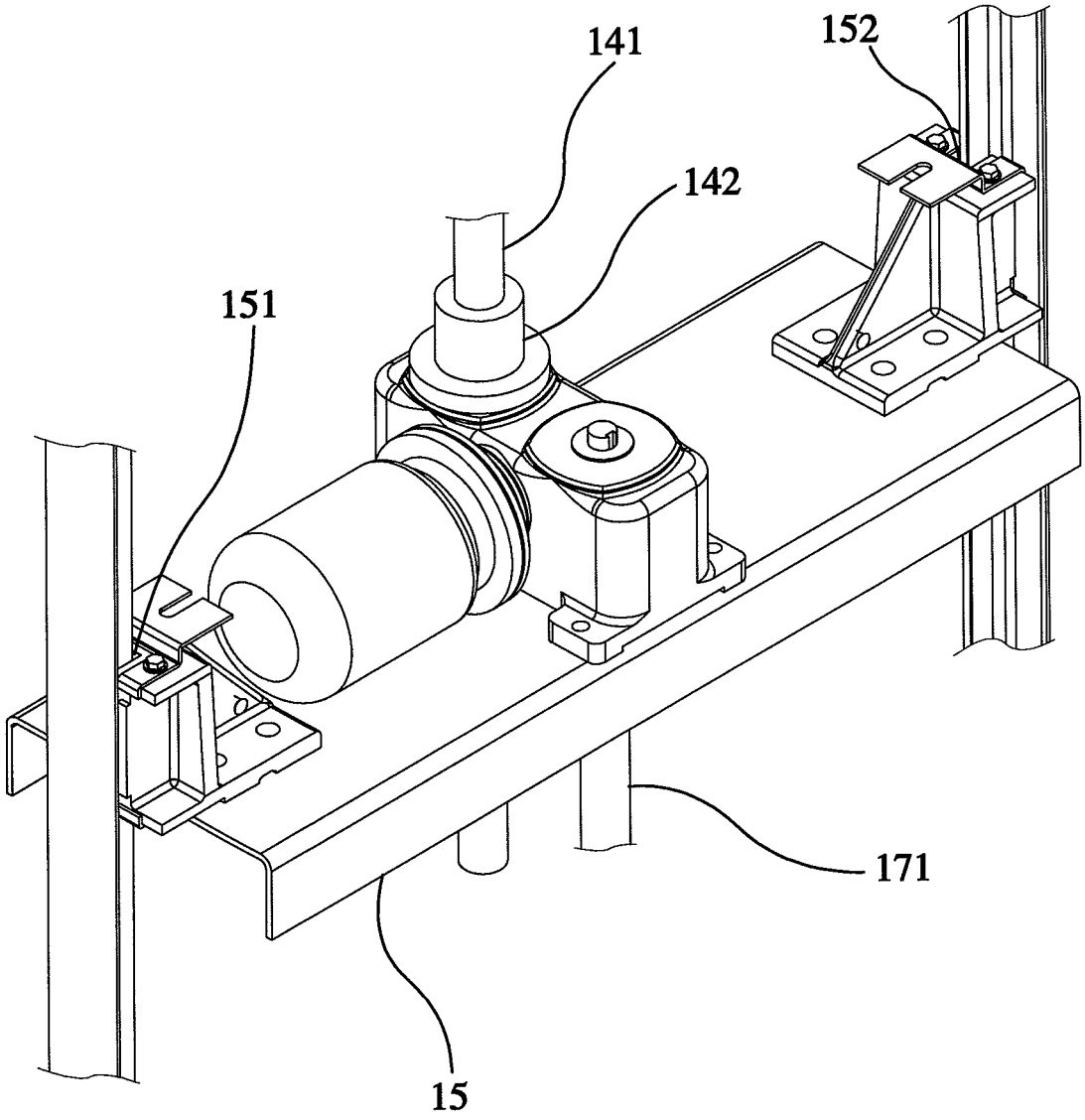
FIG. 2 is a partial enlarged view of the preferred embodiment of the present invention, showing an elevator and a power device.
Figure 3:
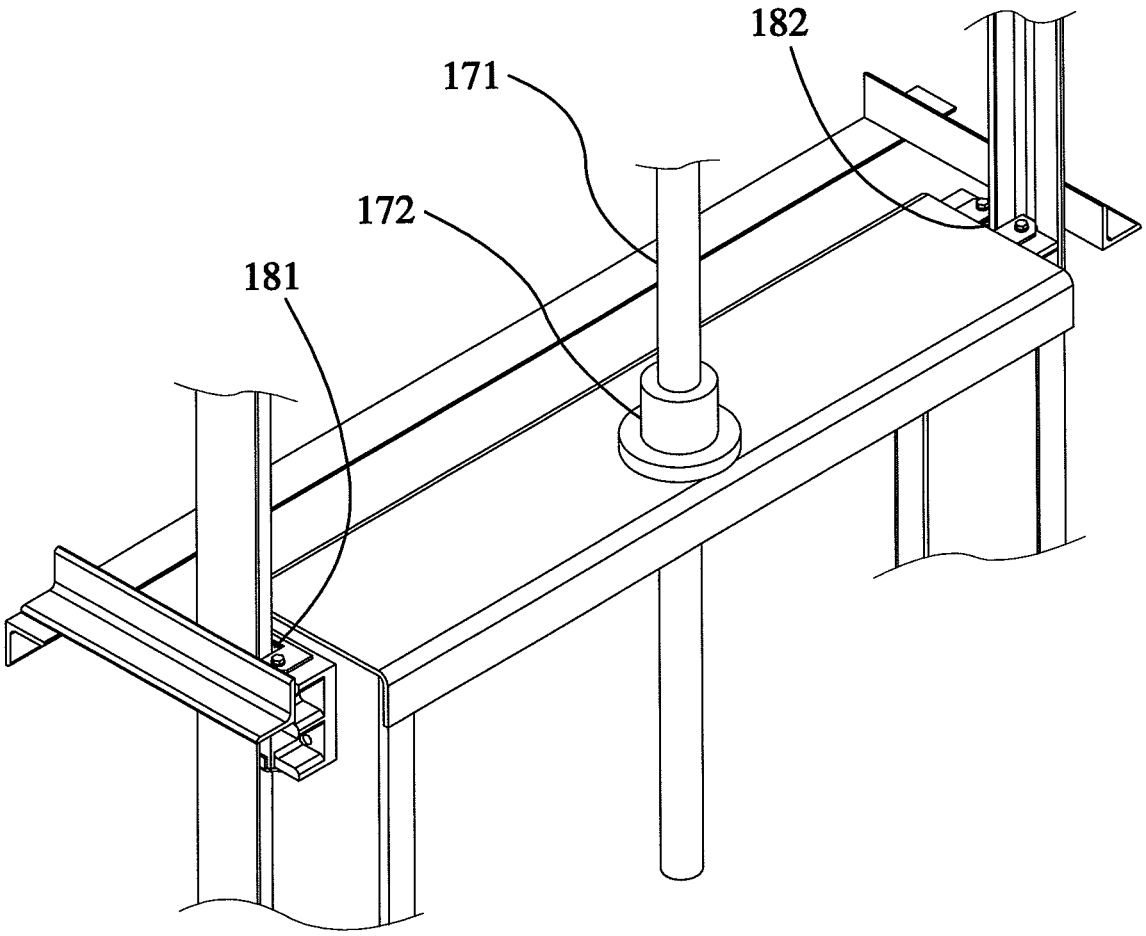
FIG. 3 is a partial enlarged view of the preferred embodiment of the present invention, showing a moving body.
Figure 4:
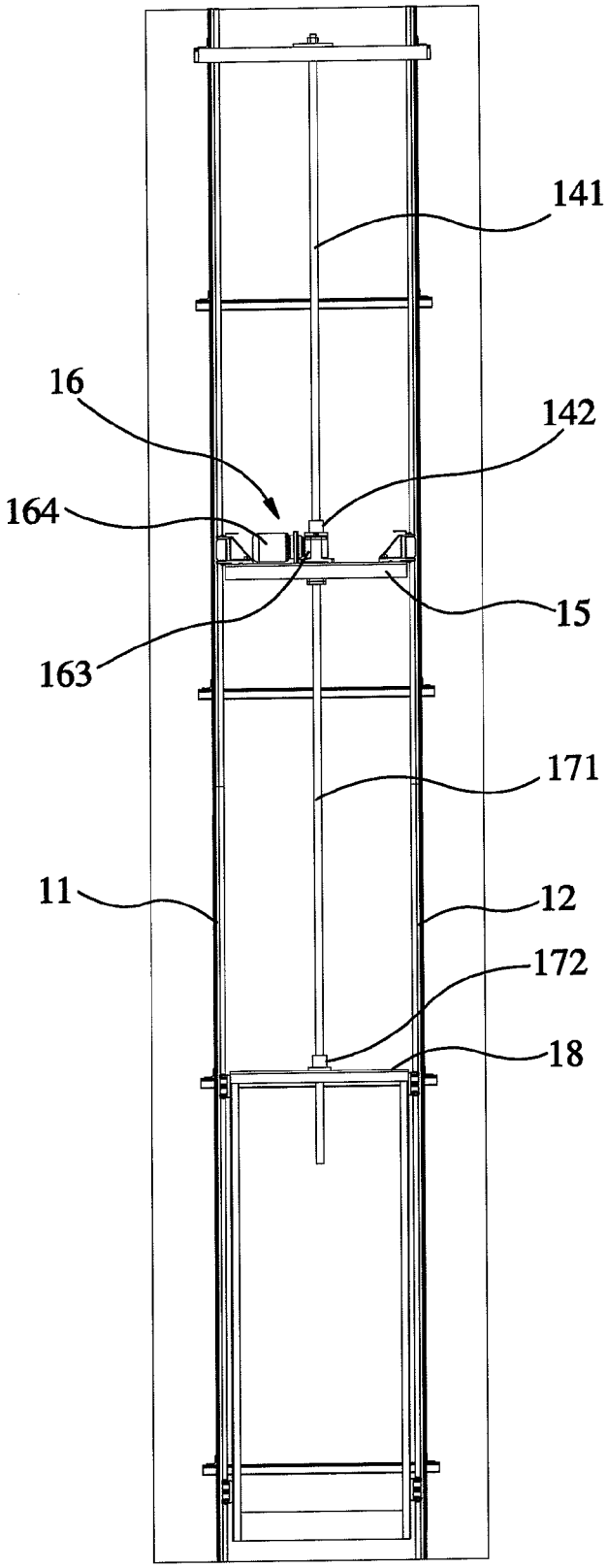
FIG. 4 is a schematic view of the operation of the preferred embodiment of the present invention, showing the moving body moving up.
Figure 5:
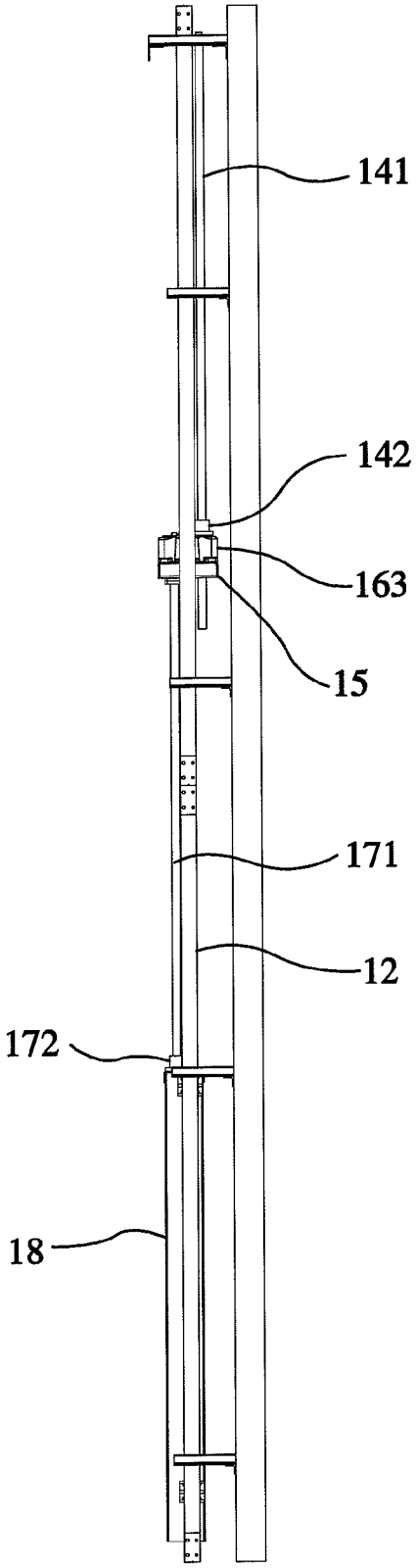
FIG. 5 is a schematic view of the operation of the preferred embodiment of the present invention, showing the moving body moving up.
Figure 6:
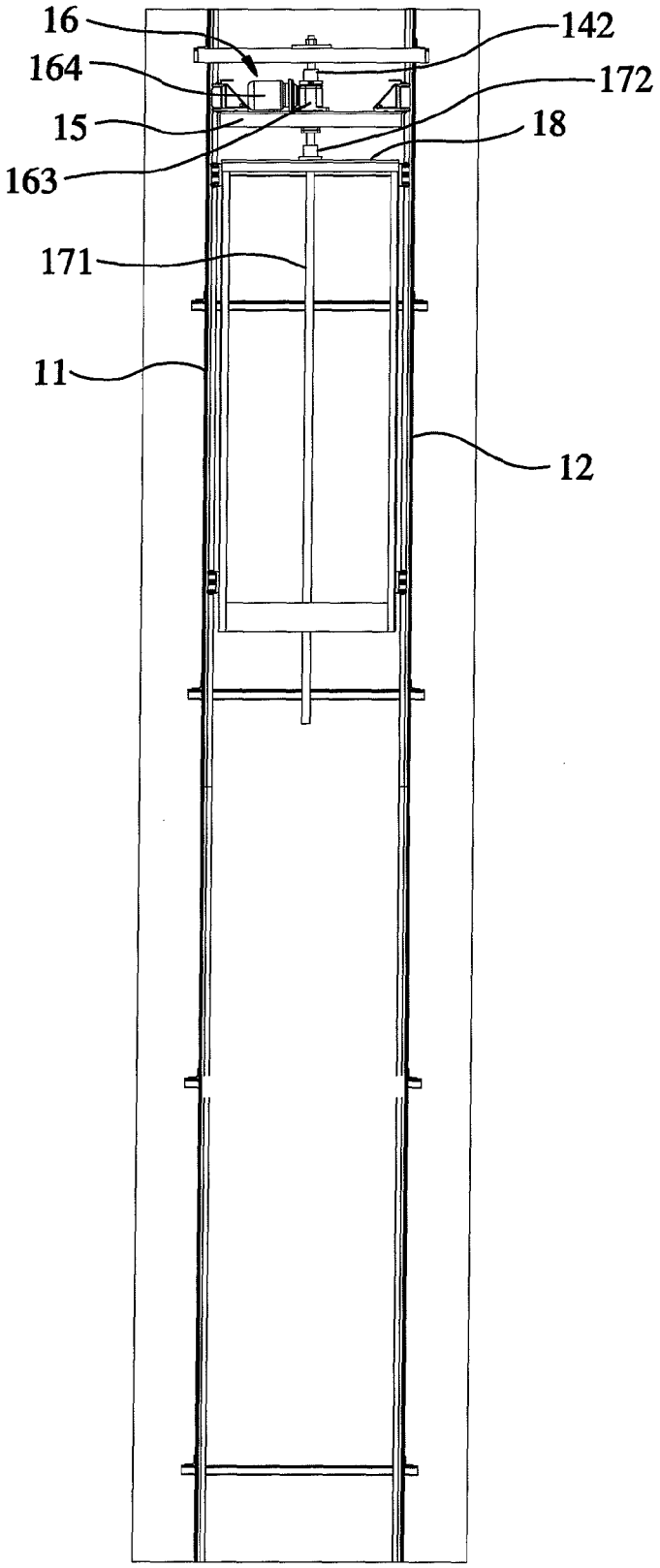
FIG. 6 is a schematic view of the operation of the preferred embodiment of the present invention, showing the moving body moving down.
Figure 7:
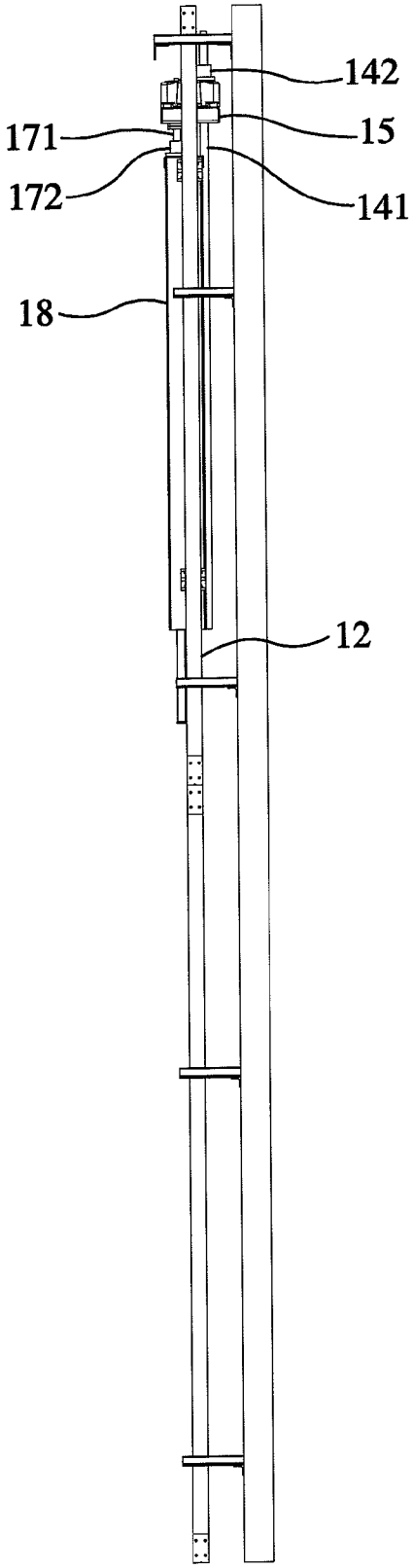
FIG. 7 is a schematic view of the operation of the preferred embodiment of the present invention, showing the moving body moving down.

Referring to FIG. 1 through FIG. 3, there are shown a perspective view and partial enlarged views of a screw-driven elevation structure according to the preferred embodiment of the present invention. The screw-driven elevation structure is disposed on a fixing plane 80. The screw-driven elevation structure comprises a first rail 11, a second rail 12, a fixing unit 13, a first screw nut assembly 14, an elevator 15, a power device 16, a second screw nut assembly 17, and a moving body 18.

The first rail 11 and the second rail 12 are parallel to each other and are disposed on the fixing plane 80.

The fixing unit 13 fixes the fixing plane 80 or the first rail 11 in place. In the preferred embodiment, the fixing unit 13 fixes the first rail 11 in place. A point to note is that the fixing unit 13 is intended to fix an object in place. For example, the fixing unit 13 fixes the fixing plane 80 or the first rail 11 in place directly or indirectly. Alternatively, the fixing unit 13 is integrally formed with the fixing plane 80 or the first rail 11 as a unitary structure.

The first screw nut assembly 14 comprises a first screw 141 and a first nut 142. The first screw 141 has a top end fixedly connected to the fixing unit 13. The first nut 142 is disposed around the first screw 141. The rotation of the first nut 142 and the first screw 141 relative to each other is accompanied by the vertical movement of the first nut 142 relative to the first screw 141. A point to note is that the first screw nut assembly 14 can be a ball screw nut assembly or a roller screw nut assembly.

The elevator 15 has two opposing ends which have a first rail slot 151 and a second rail slot 152, respectively. The first rail slot 151 accommodates the first rail 11. The second rail slot 152 accommodates the second rail 12. Hence, the elevator 15 can only move along the first rail 11 and the second rail 12 vertically, that is, upward and downward.

The power device 16 is disposed at the elevator 15. The power device 16 has a first driving portion 161 and a second driving portion 162. The first driving portion 161 is fixedly connected to the first nut 142 and drives the first nut 142 to rotate. In the preferred embodiment, the power device 16 has a gearbox 163 and a motor 164. The gearbox 163 is disposed at the elevator 15 and has the first driving portion 161 and the second driving portion 162. The motor 164 is disposed at the gearbox 163 for driving the first driving portion 161 and the second driving portion 162.

The second screw nut assembly 17 has a second screw 171 and a second nut 172. The second screw 171 has a top end fixedly connected to the second driving portion 162 and is driven by the second driving portion 162 to rotate. The second nut 172 is disposed around the second screw 171. The second nut 172 moves along the second screw 171 vertically, that is, upward and downward, while the second screw 171 and the second nut 172 are rotating relative to each other.

The moving body 18, which is designed to carry an elevator car (not shown) or an object (not shown), is disposed between the first rail 11 and the second rail 12. The moving body 18 is flanked by a third rail slot 181 and a fourth rail slot 182. The third rail slot 181 accommodates the first rail 11. The fourth rail slot 182 accommodates the second rail 12. Hence, the moving body 18 can only move along the first rail 11 and the second rail 132 vertically, that is, upward and downward. The moving body 18 is fixedly connected to the second nut 172 and moves along with the second nut 172.

Accordingly, by controlling the power device 16, it is feasible for the first driving portion 161 and the second driving portion 162 to drive the moving body 18 to move upward and downward. Hence, the screw-driven elevation structure of the present invention not only incurs a lower manufacturing cost than its conventional counterpart, but also controls single said power device 16 only and thus incurs a lower control cost than its conventional counterpart.

The preferred embodiment is described above. In the preferred embodiment, to prevent the elevator car from moving obliquely, the gearbox 163 is disposed between the first rail 11 and the second rail 12, especially in the middle of the first rail 11 and the second rail 12 is best, so as to prevent the elevator car from moving obliquely and enable the elevator car to operate steadily.

The operation of the preferred embodiment is described below.

To allow the moving body 18 to move along the first rail 11 and the second rail 12 vertically, it is necessary to start the motor 164 of the power device 16 such that the motor 164 drives the gearbox 163, thereby enabling the first driving portion 161 and the second driving portion 162 to drive the first nut 142 and the second screw 171 to rotate.

With the second screw 171 rotating, the second nut 172 disposed around the second screw 171 moves along the second screw 171, and in consequence the moving body 18 fixedly connected to the second nut 172 moves along with the second nut 172. At this point in time, due to its rotation, the first nut 142 moves along the first screw 141 vertically, that is, upward and downward, thereby driving the elevator 15 to move along the first rail 11 and the second rail 12.

Both the first screw nut assembly 14 and the second screw nut assembly 17 have a lead. In the preferred embodiment, the first screw nut assembly 14 and the second screw nut assembly 17 have the same lead, whereas the first nut 142 and the second screw 171 have the same rotation speed. As a result, the displacement of the elevator 15 relative to the first screw 141 equals the displacement of the moving body 18 relative to the second screw 171. Alternatively, the first screw nut assembly 14 has a longer lead than the second screw nut assembly 17; meanwhile, the first nut 142 ought to have a lower rotation speed than the second screw 171. Alternatively, the first ball screw nut assembly 14 has a shorter lead than the second screw nut assembly 17, whereas the first nut 142 has a higher rotation speed than the second screw 171.

What is claimed is:

1. A screw-driven elevation structure, comprising:

a first rail and a second rail parallel to each other and disposed on a fixing plane;

a fixing unit for fixing the fixing plane or the first rail in place;

a first screw nut assembly having a first screw and a first nut, the first screw having a top end fixedly connected to the fixing unit, and the first nut being disposed around the first screw and moving vertically along the first screw while the first nut and the first screw are rotating relative to each other;

an elevator with two opposing ends having a first rail slot and a second rail slot, respectively, the first rail slot accommodating the first rail, and the second rail slot accommodating the second rail, thereby restricting the elevator to vertical movement along the first rail and the second rail;

a power device disposed at the elevator and having a first driving portion and a second driving portion, the first driving portion being fixedly connected to the first nut and driving the first nut to rotate;

a second screw nut assembly having a second screw and a second nut, the second screw having a top end fixedly connected to the second driving portion and being driven by the second driving portion to rotate, and the second nut being disposed around the second screw and moving vertically along the second screw while the second screw and the second nut are rotating relative to each other; and a moving body disposed between the first rail and the second rail and flanked by a third rail slot and a fourth rail slot, the third rail slot accommodating the first rail, and the fourth rail slot accommodating the second rail, thereby restricting the moving body to vertical movement along the first rail and the second rail, the moving body being fixedly connected to the second nut and moving along with the second nut, wherein the first driving portion and the second driving portion of the power device respectively drive the first nut and the second screw to rotate at a same time when the power device is started.

2. The screw-driven elevation structure of claim 1, wherein the fixing unit fixes the first rail in place.

3. The screw-driven elevation structure of claim 1, wherein the first screw nut assembly or the second screw nut assembly is a ball screw nut assembly.

4. The screw-driven elevation structure of claim 1, wherein the first screw nut assembly or the second screw nut assembly is a roller screw nut assembly.

5. The screw-driven elevation structure of claim 1, wherein the power device has a gearbox and a motor, the gearbox being disposed at the elevator and having the first driving portion and the second driving portion, and the motor being disposed at the gearbox for driving the first driving portion and the second driving portion.

6. The screw-driven elevation structure of claim 5, wherein the gearbox is disposed between the first rail and the second rail.

7. The screw-driven elevation structure of claim 1, wherein the first screw nut assembly and the second screw nut assembly have a same lead, wherein the first nut and the second screw have a same rotation speed.

8. The screw-driven elevation structure of claim 1, wherein the first screw nut assembly has a longer lead than the second screw nut assembly, and the first nut has a lower rotation speed than the second screw.

9. The screw-driven elevation structure of claim 1, wherein the first screw nut assembly has a shorter lead than the second screw nut assembly, and the first nut has a higher rotation speed than the second screw.

* * * * *